US007441352B2

(12) United States Patent
Gardi

(10) Patent No.: US 7,441,352 B2
(45) Date of Patent: Oct. 28, 2008

(54) STRUCTURE WITH VARIABLE GEOMETRIC PATTERN AND APPEARANCE

(75) Inventor: Chanan Gardi, Impruneta Firenze (IT)

(73) Assignee: Editoriale Friulana S.R.L., Udine (IT)

( * ) Notice: Subject to any disclaimer, the term of this patent is extended or adjusted under 35 U.S.C. 154(b) by 0 days.

(21) Appl. No.: 11/188,343

(22) Filed: Jul. 25, 2005

(65) Prior Publication Data

US 2006/0010732 A1 Jan. 19, 2006

Related U.S. Application Data

(63) Continuation of application No. 10/390,409, filed on Mar. 17, 2003, now abandoned.

(51) Int. Cl.
*G09F 1/00* (2006.01)

(52) U.S. Cl. ..... 40/124.191; 40/124.11

(58) Field of Classification Search ..... 40/124.191, 40/124.11, 124.01, 124.12; 434/81; 446/147
See application file for complete search history.

(56) References Cited

U.S. PATENT DOCUMENTS 1,440,487 A * 1/1923 Newell ..... 446/339
1,976,049 A * 10/1934 Vansant ..... 353/75
2,114,801 A * 4/1938 King ..... 472/57
2,547,359 A * 4/1951 Bacharach ..... 446/147
5,551,730 A * 9/1996 Barreca et al. ..... 283/117
6,209,924 B1 * 4/2001 Pyle et al. ..... 283/117
2004/0088893 A1 * 5/2004 Mahoney ..... 40/124.11

* cited by examiner

*Primary Examiner*—Gary C Hoge
(74) *Attorney, Agent, or Firm*—McGlew & Tuttle, P.C.

(57) ABSTRACT

A structure with variable geometric pattern and appearance which comprises:

a first element having a first aperture whose outline defines a preset geometric or fancy figure;

a flap or patch of fabric or cloth applied on the rear surface of said first element;

a second element associated with the rear surface of said first element on the back of said fabric so that the said fabric will result interposed between the first and second elements, the same fabric being able to partly project from the surface defined by said first element or said second element, the surface of the latter being provided, likewise the surface of the first element, with one or more apertures; the said one or more apertures defining one or more writings and/or figures intended to result inside the area delimited by said first aperture and visible against the light through the cloth.

10 Claims, 10 Drawing Sheets

1
2
3
4
10
14
40

140
140
S
S
8
8
80
1
2
3
4
4
4
4
40
40
7

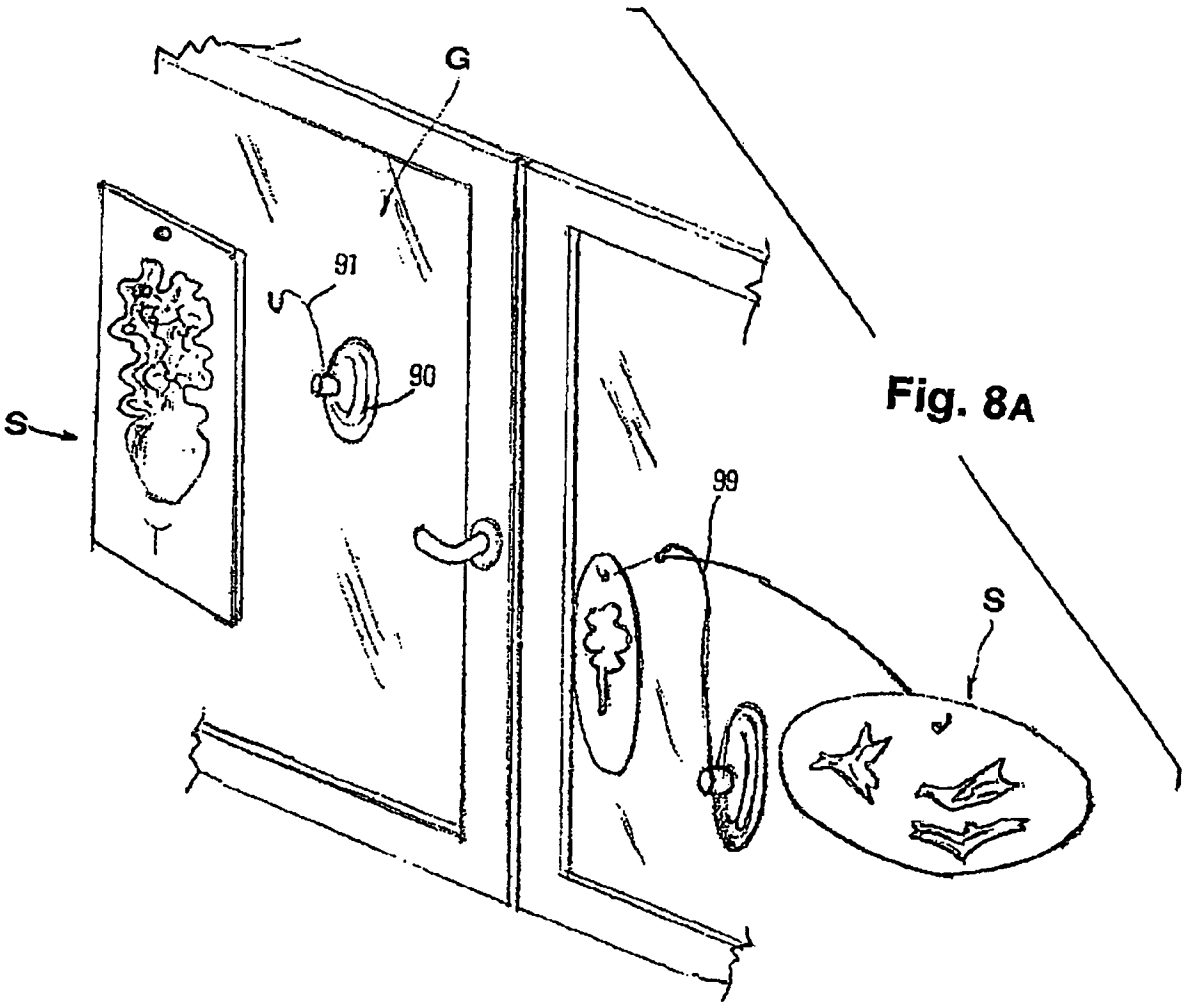
Fig. 8A
Fig. 8B
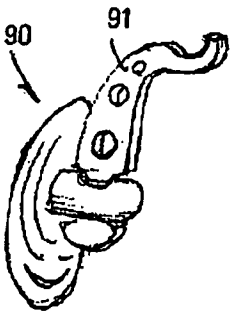
Fig. 8C

STRUCTURE WITH VARIABLE GEOMETRIC PATTERN AND APPEARANCE

This is a Continuation of application Ser. No. 10/390,409 filed Mar. 17, 2003 now abandoned, and the entire disclosure of this prior application is considered to be part of the disclosure of the accompanying application and is hereby incorporated by reference therein.

The present invention refers to a structure with variable geometric pattern and appearance, especially, although not exclusively, for use in making stationery, as well as envelopes or packages.

The present invention is utilizable as a greeting card with a particular pleasing effect deriving from the association of a light source behind the card, from the contrasting light and dark surface between the front face and front of the backface of the card and from the multiple angles and paths the light can take as it passes through cutout and fabric, as will be better explained in the present description.

BACKGROUND OF THE INVENTION

U.S. Pat. No. 5,551,730 to Barreca et al. discloses an aesthetically pleasing greeting card having a stained-glass window effect provided by a pattern of cut-outs in a face panel thereof and a panel of translucent material having a corresponding colored pattern which allows the transmission of light through it to provide a stained-glass effect. The translucent material is always behind, not in front, of the cutout and because of this multiple images projection variations are not possible here. In addition, there is a clear and distinct relationship between the color(s) on the translucent material and the openings in the cutout in front of it. Each color is meant to be exactly where it is behind the paper cutout design as is the case of a stained glass window. In addition, the image is essentially always the same in all lights, as in a stained glass window, since the light only modifies the intensity of color on the translucent material. There are no surprising light effects created by multiple light paths and angles and by light reflections and surface color contrast.

SUMMARY OF INVENTION

According to the present invention, it is possible to obtain a greeting card which changes its images in relation to its exposure to light. Here, there are multiple visual impressions and image projections which can be created through the interplay of several factors. These are: the unattached fabric in front of the cutout which allows for multiple light paths through fabric and cutout and multiple image projections, the back surface of the card which provides light or dark contrast to the cutout and reflects light back through image and fabric and the variable angles of both the front and back of the card which, in turn alters the angles that light passes back and forth through cutout and fabric. All the above creates a structure according to the invention, which allows the user to interact with and to alter the appearance thereof, for play or amusement. Moreover, the present structure is relatively easy and cost-effective to make, and can be used for making article of various kind such as postcards and greetings cards, calendars, covers and internal pages of books, notebooks and diaries, envelopes, lids for boxes and containers in general, key cases, cellular cases, spectacle cases, bags, belts, purses, masks and others. This result has been achieved, according to the present invention, by adopting the idea of making a structure having the characteristics indicated in the claim 1. Further characteristics being set forth in the dependent claims.

BRIEF DESCRIPTION OF THE DRAWINGS

In the description that follows, reference will be made to the attached drawings which are to be considered by way of non limiting example, wherein:

FIG. 1 is a schematic exploded perspective view of a structure, according to the present invention, intended for making up a greetings card or the like, by which it is possible to play simple animation games;

FIGS. 8A-8C, 9A-9C and 10 show further embodiments and uses of a structure according to the invention and, in particular, FIG. 8 is a partial perspective view of a suspended ornamental structure in two possible applications for the glass of a window, FIG. 8B is a lateral view relevant to an application of the previous figure, FIG. 8C is a perspective view of a support element for holding the structure, FIG. 9A is a partial perspective view of a suspended ornamental structure associable to a table, FIG. 9B is a perspective view relevant to an application similar to the one of the previous figure, FIG. 9C is a perspective view of a support element for holding the structure in association to a table, FIG. 10 is a perspective view of a possible example of a suspended structure with many arms;

DETAILED DESCRIPTION OF THE INVENTION

Figures 1A, 1B, 1C, 1D:
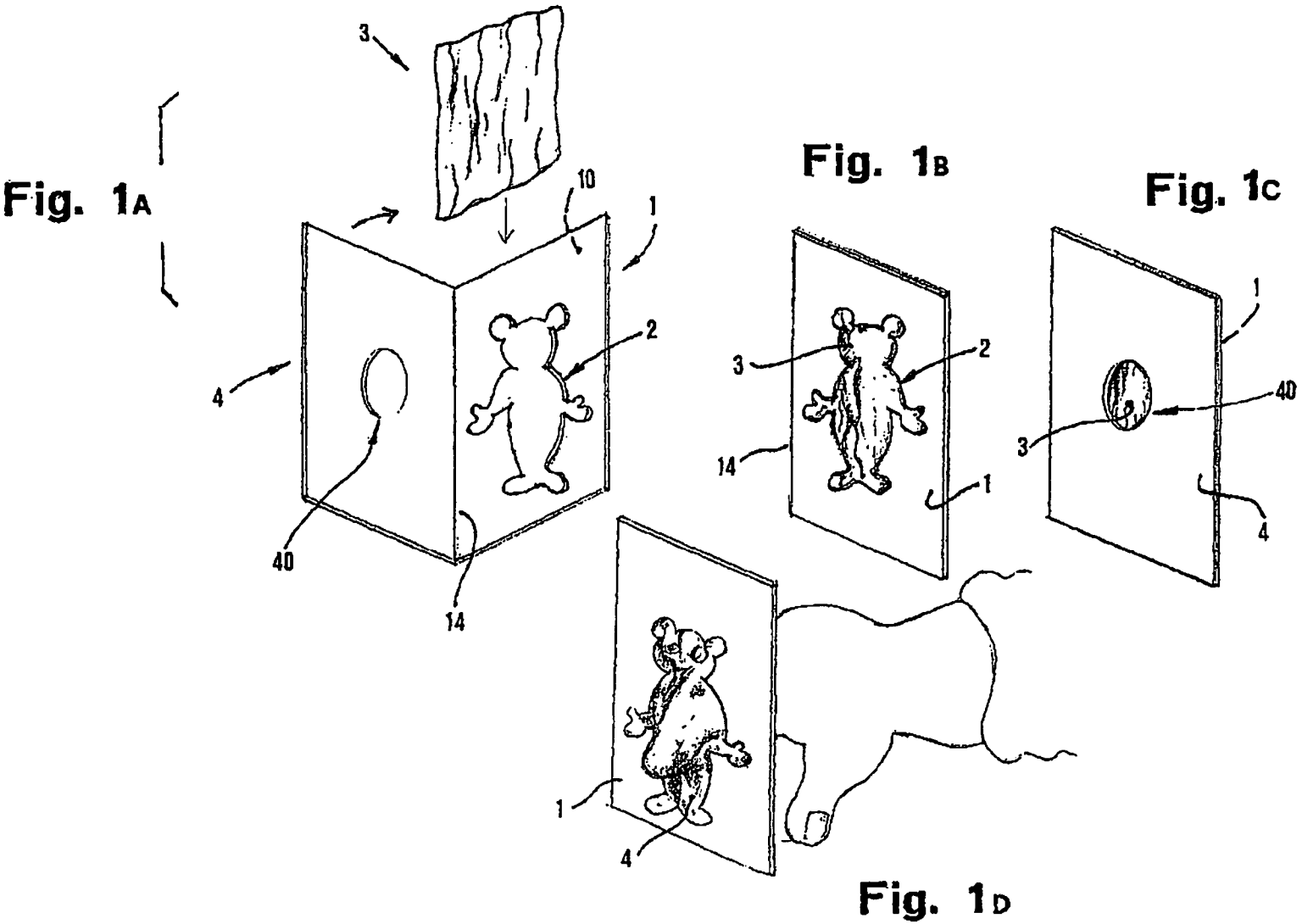
FIG. 1B is a schematic antero-lateral perspective view of the structure of FIG. 1A after the assembly thereof.
FIG. 1C is a schematic lateral-dorsal perspective view of the structure of FIG. 1A after the assembly thereof.
FIG. 1D shows the example of the preceding figures for use in a simple animation game.

With reference to the examples shown in FIGS. 1A-1D, 2A-2B, 3A-3C, 4A-4C, 5A-5D, 6A-6H, 7A-7J, 8A-9B, 9A-9B, 10, 11A-11B of the attached drawings, a structure according to the invention comprises:

- a first element 1, for example made of cardboard, plastics or other suitable material, on which a first aperture 2 is formed whose outline defines a predetermined geometric or fancy figure;
- a flap or patch of fabric or cloth 3 applied on the rear surface 10 of said first element 1;
- a second element 4 applied on the rear surface 10 of said first element 1 on the back of fabric 3, so that the fabric will result interposed between the first element 1 and the second element 4.

Said first and second elements 1, 4 may form one body, as they are joined in correspondence of a fold of same body, as illustrated in the examples of FIGS. 1A-1D, 2A-2B, 3A-3C.

Alternatively, the two elements 1 and 4 may also be separated at first, to be associated by gluing when forming the structure.

The second element 4 of the structure may, in turn, be joined to a third element 5 in correspondence of a fold 45 of said one body. The said folds 1, 45 define two axes of hinge-like connection between said elements 1, 4 and 4, 5, thereby allowing them to be opened/closed like a book when assembling the structure or during its use.

The cloth 3 is loosely applied on the back of the first element 1, or is sufficiently elastic as to partially coming out through the shaped aperture 2 when pushed from the back.

The second element 4 may be provided, in turn, with one or more apertures. In the example of FIGS. 1A-1D, the second element 4 is provided with only one central aperture 40 which allows simple animation games to be performed, as shown in FIG. 1D, by pushing the cloth from the back by the fingers of one hand. In the example of FIGS. 2A-2B, 3A-3B and 11A-11C, the second element 4 is provided with more apertures 41 which, in the whole, can define one or more words (greetings, for example) or one or more figures intended to result inside the area delimited by the aperture 2 of the first element 1 and viewable against the light through the cloth 3, thereby completing and enriching the figure defined by said aperture 2 and cloth 3.

Figure 11C:
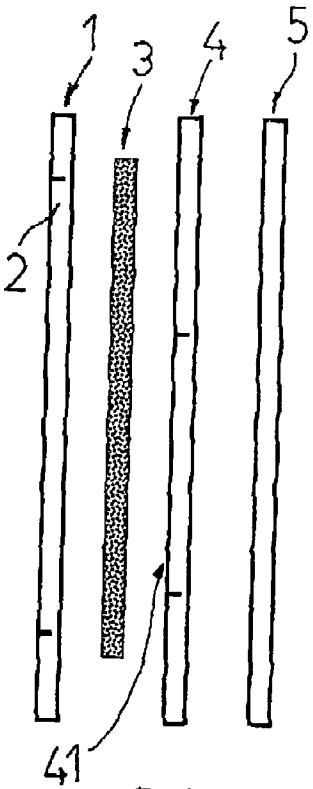
FIGS. 11B and 11C are, respectively, a perspective view (FIG. 11B) and a lateral view (FIG. 11C) (not in scale) of the embodiment shown in FIG. 11A.
Figure 11B:
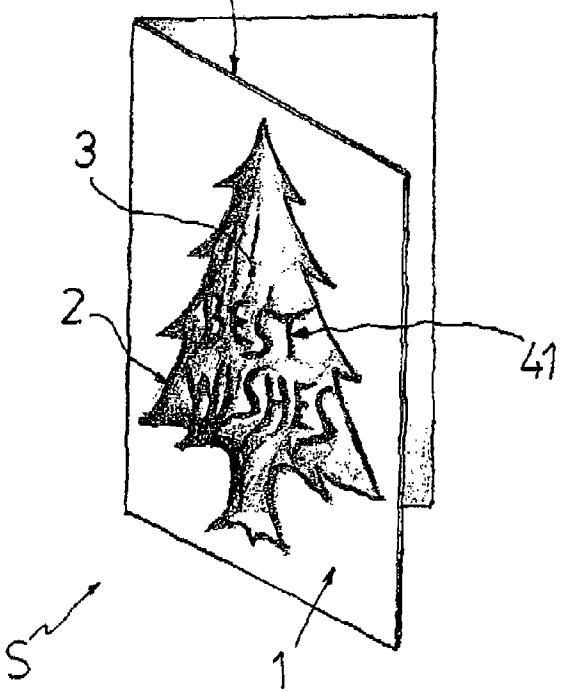
Figure 11A:
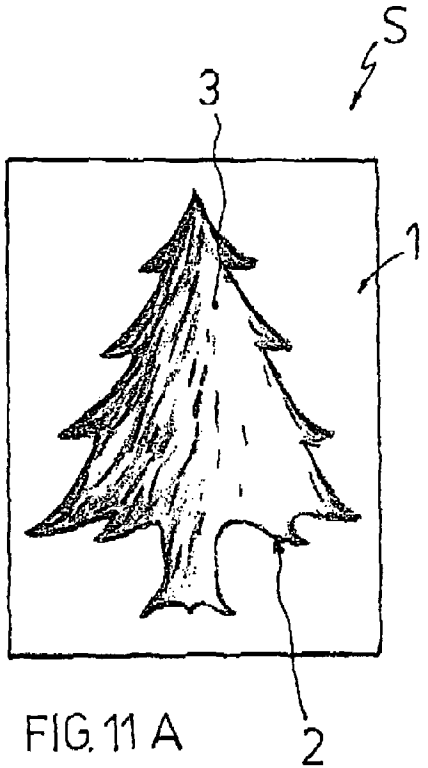
FIG. 11A is a plan view of a further embodiment of the present invention.

In FIGS. 11A-11B is shown the difference between the structure (marked with S) closed (FIG. 11A) and the structure S open (FIG. 11B) and exposed to a light source. In practice, the structure, if exposed to a light source, change its appearance, showing particulars which are not shown without the light.

This is obtained because, according to the invention, the structure has at least:

- a first element 1 having an aperture 2 whose outline defines a preset geometric or fancy figure;
- a flap or patch of fabric or cloth 3 applied on the rear surface 10 of said first element 1;
- a second element 4 associated with the rear surface of said first element 1 on the back of said fabric 3 so that the said fabric will result interposed between the first 1 and second 4 elements, the same fabric being able to partly project from the surface defined by said first element 1 or said second element 4, the surface of the latter being provided, likewise the surface of the first element 1, with one or more apertures 40; 41; the said one or more apertures 40; 41 defining one or more writings and/or figures intended to result inside the area delimited by said first aperture 2 and visible against the light through the cloth 3.

For producing the structure, it is possible to use a computer programmed laser cutting to create the cut-out, in particular to create the cut-outs which define the apertures of the second element 4.

For obtaining the surprising effect given by the structure S, it is important that the cut-out is behind (not in front as in U.S. Pat. No. 5,551,730 cited above) of the fabric material.

The fabric or cloth 3 is an unattached fabric which provides a geometrically variable surface, which, in turn, creates multiple impression of the cut-out. By moving the structure S (in open configuration) from place to place or moving the face of the structure S an infinite number of projections of the cut-out design is created. It is possible to have an infinite number of visual impressions of the design because the light passes through at different angles.

Furthermore, in the present structure no attempt is made to align any color on the fabric with the cut-out. In other words, there is no corresponding relationship between either the fabric or the color on the fabric to the cut-out design.

The same cut-out design can be used with unlimited types of color patterns on the materials.

Figure 2B:
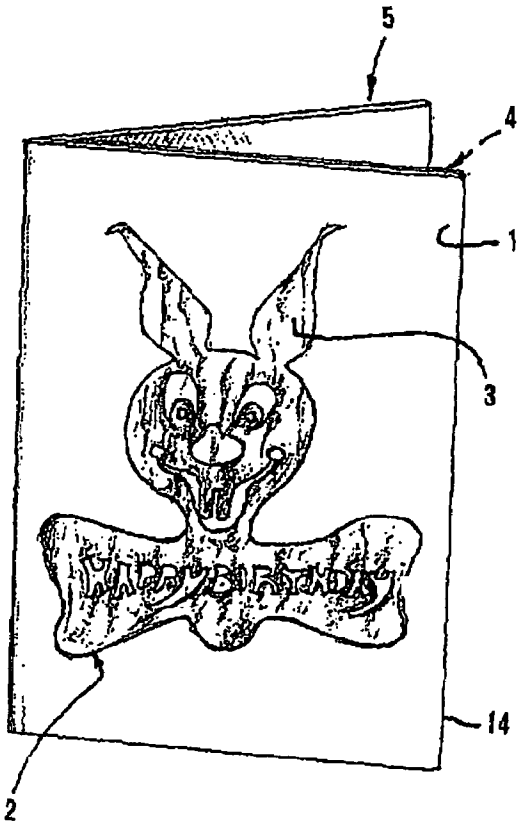
FIG. 2B shows the object of FIG. 2A after the assembly thereof.
Figure 2A:
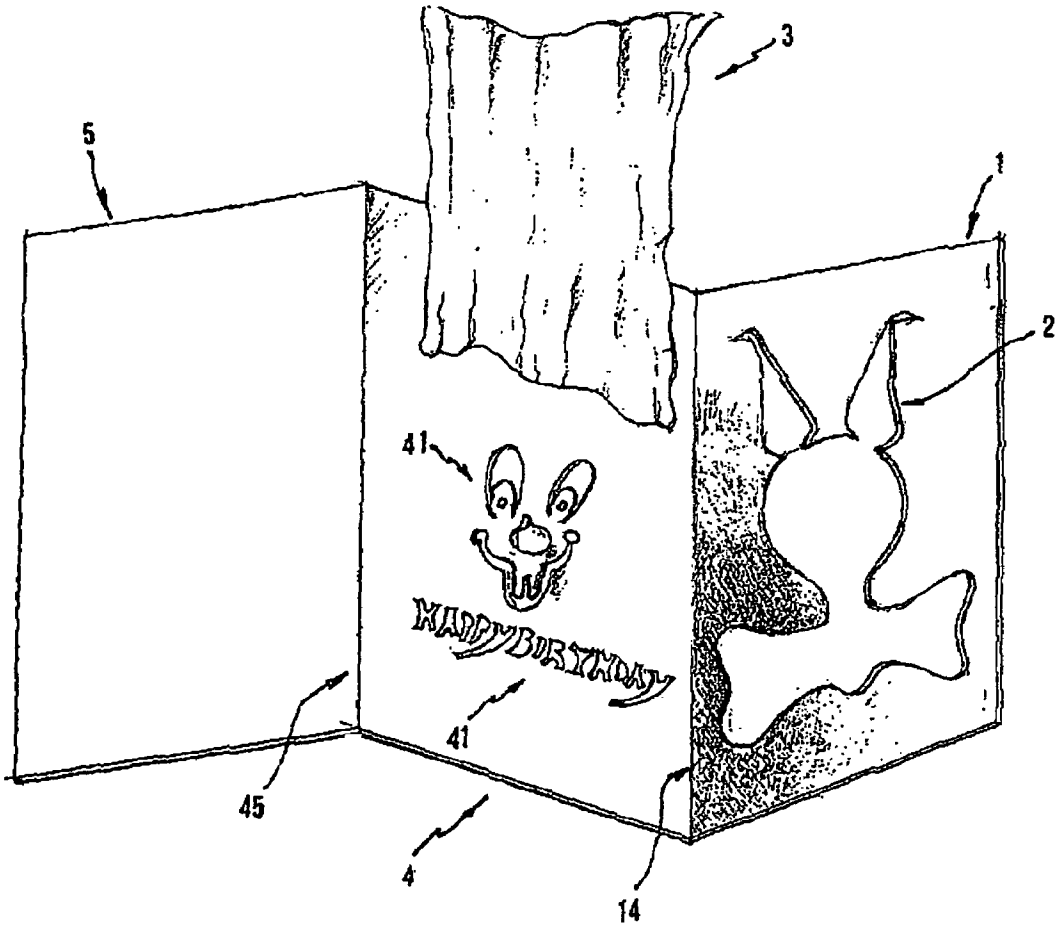
FIG. 2A shows a second embodiment and use of the structure according to the invention, in a schematic exploded perspective view.

The back of the inside of the structure S itself is important in creating the multiple impressions of the cut-out. In the example of FIGS. 2A-B, the back of the structure, i.e. the element 5 is a third element 5 joined to the second element 4 in correspondence of a fold 45.

The third element 5 can be formed by a third surface applied on the rear of the second element 4, forming the back of the structure. This embodiment is shown in FIG. 11C.

The back 5 of the structure (i.e. the third element) can be a white or light beige surface which reflects the light at different angles. But also provides a contrast to the dark surface of the cutting itself. The cut-out design is preferably done in a dark color to provide a contrast to the lighter colored back face 5 of the structure S. Utilizing a computer programmed laser cutting it is possible to obtain a cut-out executed in dark color. The contrast between the color of the paper in the cut-outs and in the back surface 5 is preferably maintained. It is possible to get similar effects with a light colored cut-out and a darker colored surface behind it since the contrast itself is maintained.

Figure 3A:
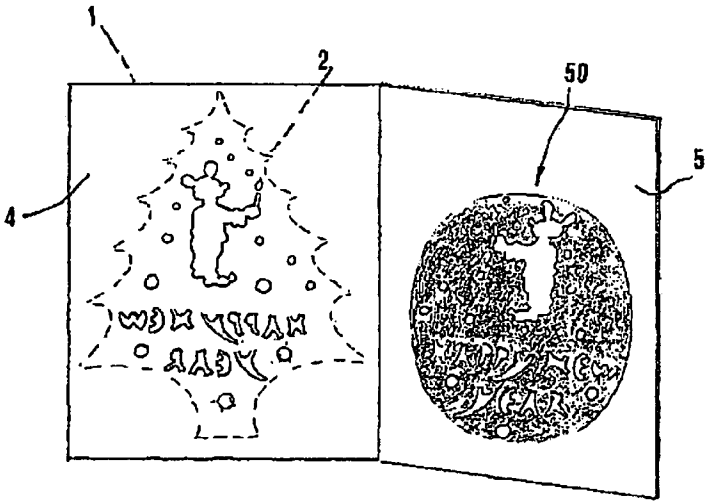
FIG. 3A is a schematic perspective view of the internal pages of a third embodiment and use of a structure according to the invention.
Figure 3B:
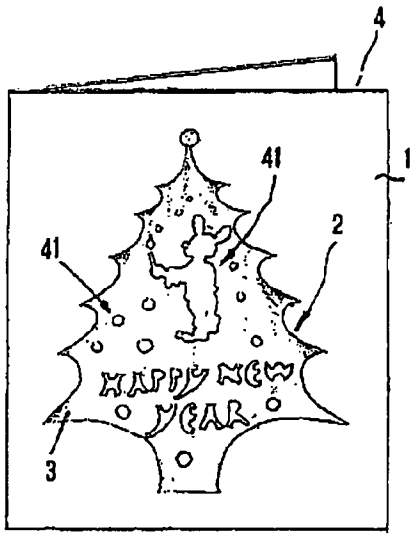
FIG. 3B shows schematically the object of FIG. 3A as viewed from the side of the front page or cover.
Figure 3C:
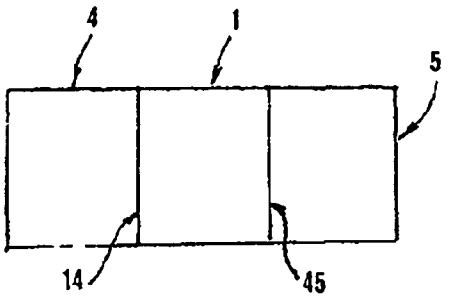
FIG. 3C shows schematically a plane development of the structure of FIGS. 3A and 3B.

In the example illustrated in FIGS. 3A-3C, the said third element 5 exhibits a mirror-like reflecting surface 50 in which the cloth 3 and FIGS. 42 reflect by filtering against the light through the fabric.

Figures 4A, 4B, 4C:
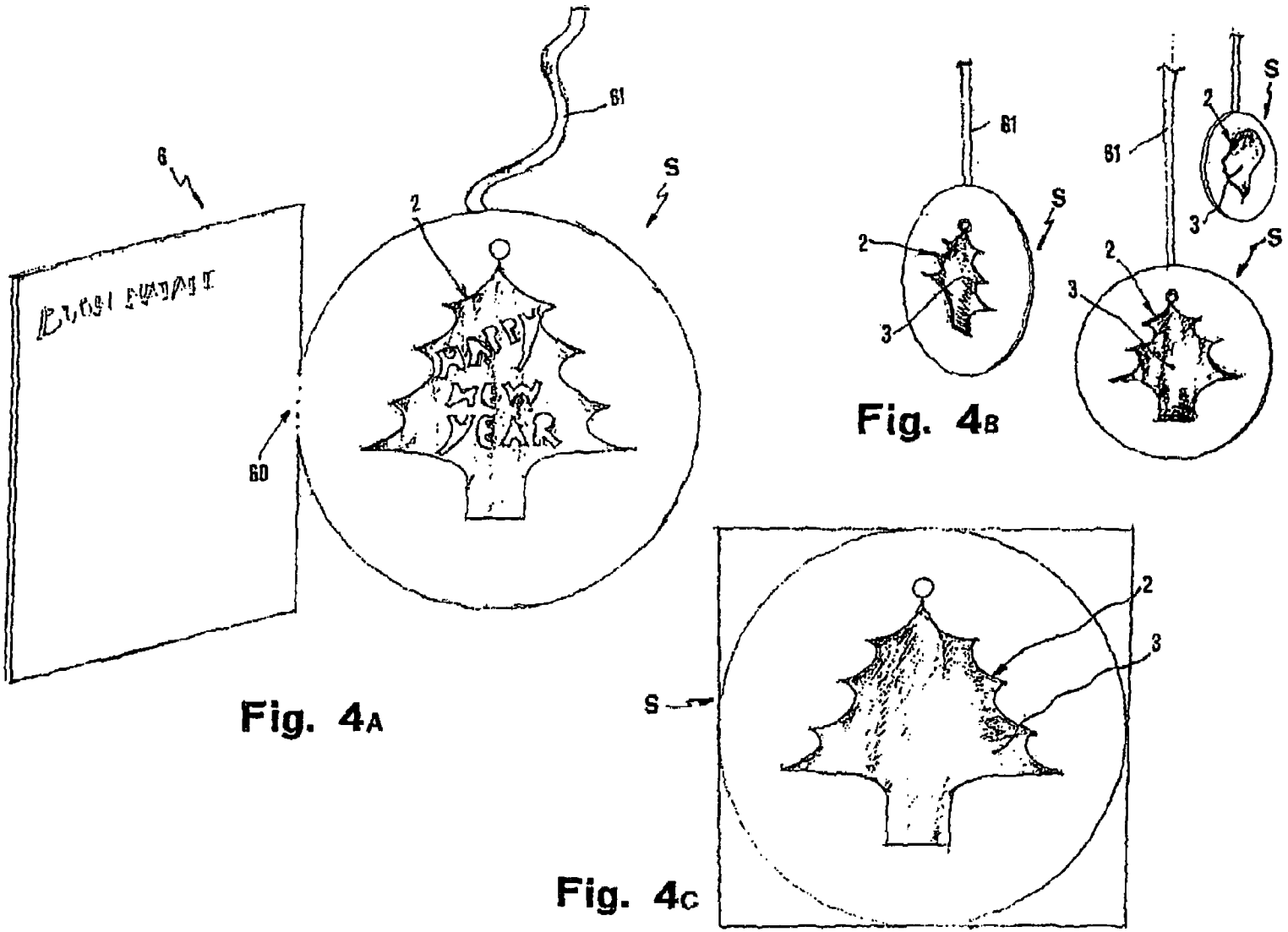
FIG. 4A is a perspective view of a fourth embodiment and use of a structure according to the invention.
FIG. 4B shows a separate element of the object of FIG. 4A.
FIG. 4C is a front view of the embodiment of FIG. 4A.
Figures 5A, 5B, 5C, 5D:
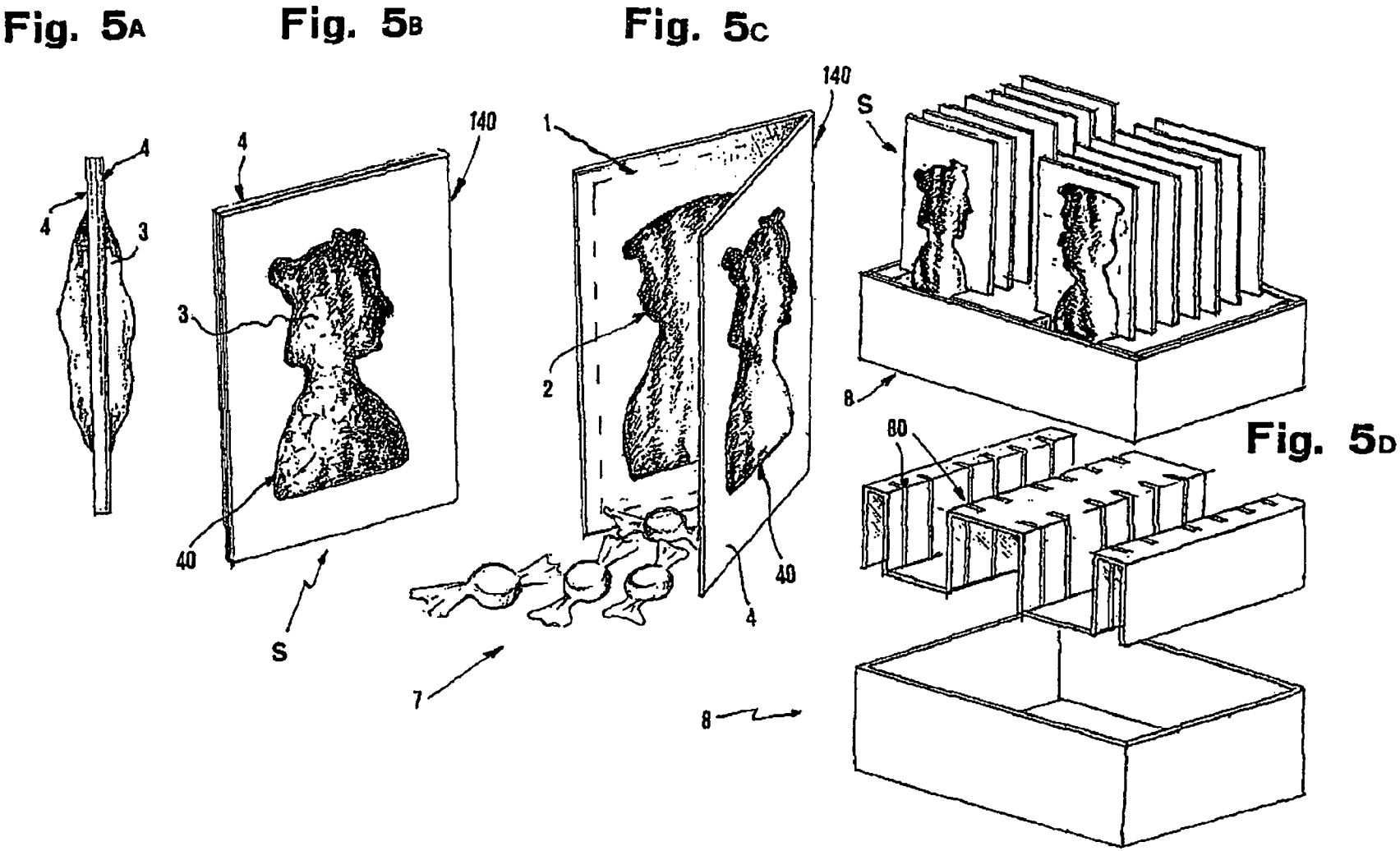
FIG. 5A shows a fifth embodiment and use of a structure according to the invention, in open configuration.
FIG. 5B is a schematic, antero-lateral perspective view of the object of FIG. 5A, in closed configuration.
FIG. 5C is a side view of the object of FIG. 5B.
FIG. 5D is a schematic exploded perspective view of a container-display stand in which more objects of the type shown in FIGS. 5B and 5C can be disposed.

As shown in the example of FIGS. 4A-4C, the structure (S) according to the invention is removably associated with a greetings card 6 in correspondence of a perforated or pre-cut line of connection 60 allowing it to be detached by hand, and is provided with a ribbon or cord 61 by means of which it can be suspended (for example, at a branch of a Christmas tree) for decorative purpose.

In the example relating to FIGS. 5A-5D, a structure is shown to be used, for example, for containing small objects such as sweets and small cakes 7 which, upon closing the package thus made, push the cloth 3 from the inside by causing an irregular, that is, casual swelling thereof. More envelopes of this kind can be easily put on display-stands 8 provided with relevant slits 80 which define receiving seats. A possible example of embodiment of the structure illustrated in FIGS. 5A-5D may be provided with a single front element 1 having two apertures 2, and a single rear element 4 provided with two corresponding apertures 40 having the same shape as the apertures 2. In particular, the apertures reproduce two human profiles. Provided between the two elements 1 and 4 is the cloth 3 which, as previously stated, defines, in closed condition, a kind of small bag for holding sweets 7. Numeral 140 designates a central folding line which subdivides the structure into two equal parts.

Shown in FIGS. 6A-6H are further embodiments and uses of a structure according to the invention.

Figure 6:
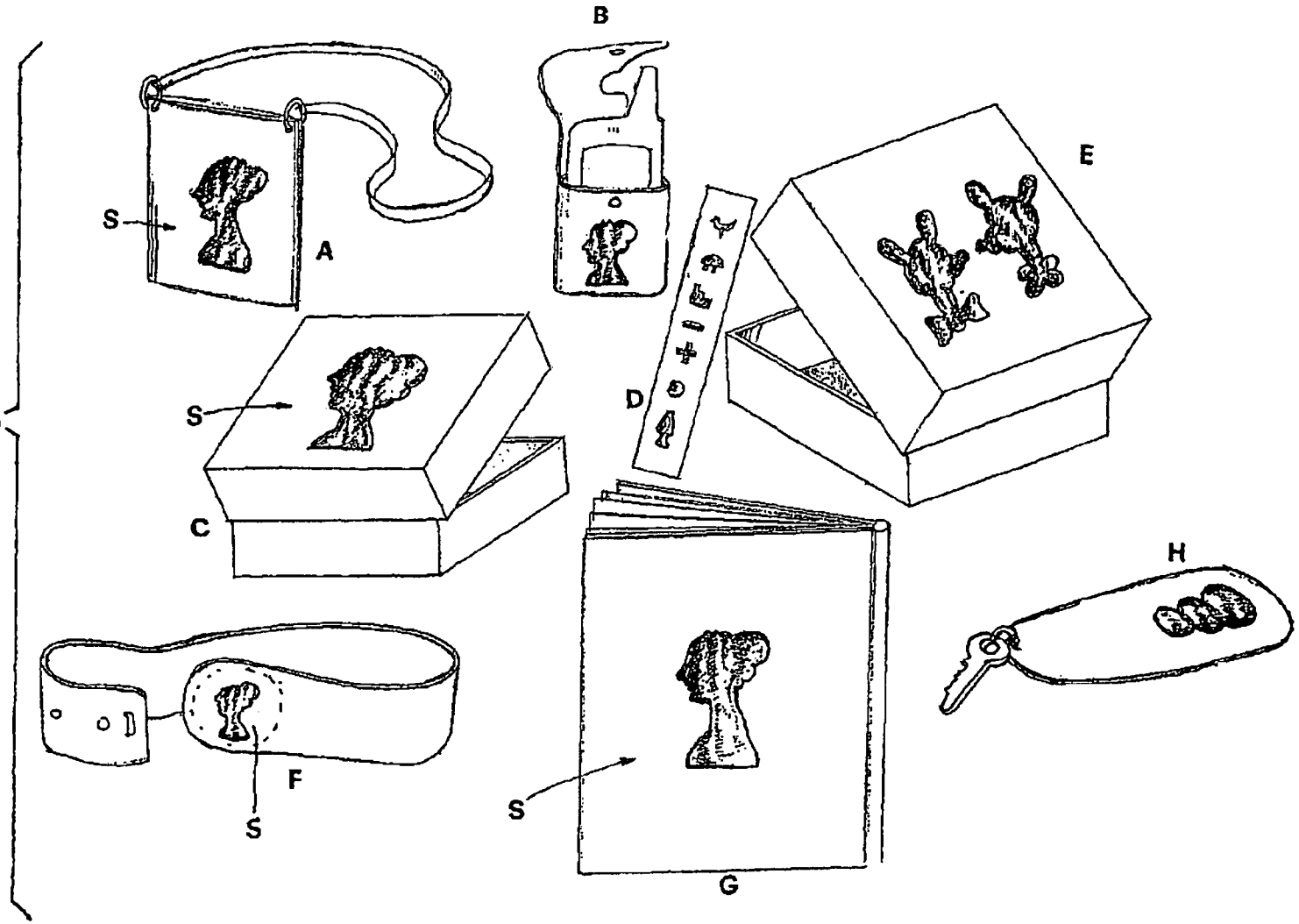
FIGS. 6A-6H show further embodiments and uses of a structure according to the invention and, in particular, a bag (FIG. 6A), a cellular case (FIG. 6B), a box (FIG. 6C), a bookmarker (FIG. 6D), a further box (FIG. 6E), a belt (FIG. 6F), a book (FIG. 6G) and a key case (FIG. 6H)

In particular, FIG. 6A shows a small shoulder-bag, while FIG. 6B shows a cellular case; in these examples, the structure S of the present invention may form the front face of the objects. In FIGS. 6C and 6E there are shown two boxes having a lid defined by the structure S. The structure S is also able to make up a bookmarker, as shown in FIG. 6D, a belt as shown in FIG. 6F in which the structure is in correspondence of the buckle, the cover of a book like in FIG. 6G or a key case, like in FIG. 6H.

Figure 7:
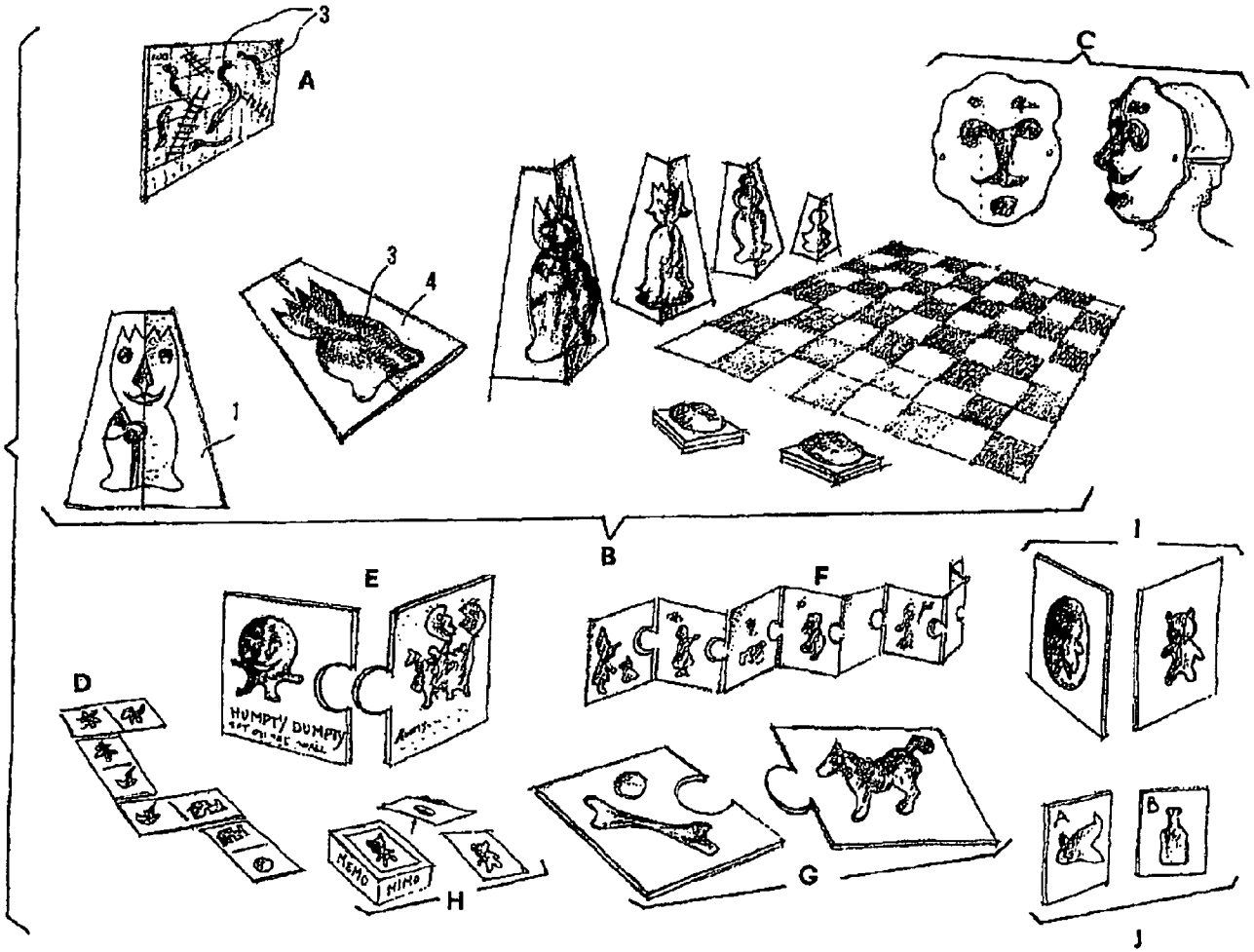
FIGS. 7A-7J show further embodiments and uses of a structure according to the invention and, in particular, a board game (FIG. 7A), a chessboard with models of chess and draught (FIG. 7B), a mask (FIG. 7C, in which the latter is shown both separate, in front view, and put on, in perspective view), some games of puzzle type (FIGS. 7E, 7F, 7G), a game with characters to be guessed (FIG. 7H) and two card games (FIGS. 7I and 7J)

FIGS. 7A-7J show further embodiments and uses of structure according to the invention, which relate in particular to games. In FIG. 7A, the structure 30 according to the invention makes up a poster for board games. In FIG. 7B a chessboard is shown with exemplary forms of chess 81 and draught 82. FIG. 7C shows a mask; in the left drawing, the mask is seen from the front side, while on the right side a perspective views shows the same mask when put on. FIG. 7D shows a dominoes game, FIGS. 7E, 7F, 7G some puzzle-type games, FIG. 7H a game with characters to be guessed (for example by keeping the eyes closed and using the touch) and, finally, FIGS. 7I and 7J show two game cards also made according to the present invention.

FIG. 8A is a partial perspective view of a suspended ornamental structure in two possible applications for the glass G of a window. The structure showed on left has a support element constituted by a sucker 90, fixable to the surface of the glass G, and a simple support arm 91. It is possible to suspend the structure S realized according to the present invention at the free end of the arm 91. The structure on right has a composite support arm 99. It is possible to suspend many structures S (two in the example) at the arm 99. FIG. 8B is a lateral view relevant to the application of left, while FIG. 8C is a perspective view of a support element for holding the structure.

Figure 9B:
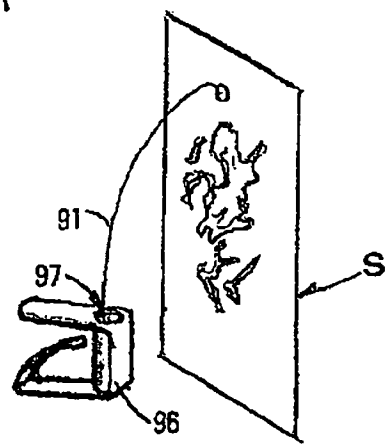
Figure 9A:
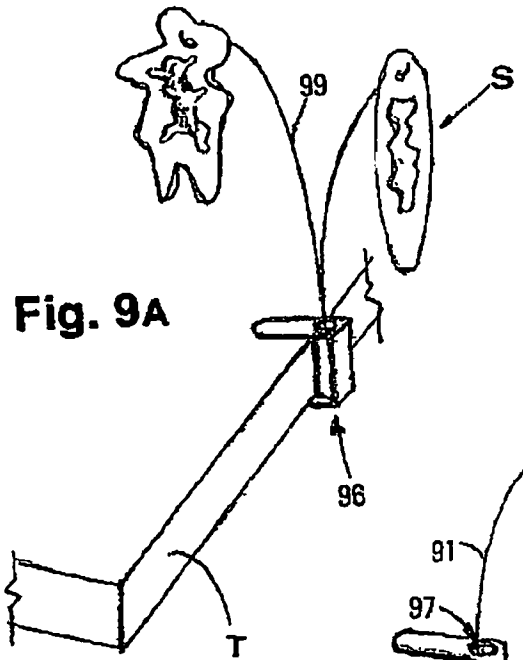
Figure 9C:
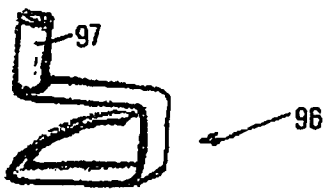

FIG. 9A is a partial perspective view of a suspended ornamental structure associable to a table T; in this example there is a multiple arm 99 that holds two structures S and the association to the table is performed by an elastic clamp 96. The elastic clamp can be realized in different ways, for example as shown in FIGS. 9A-9B: in these examples there is a different positioning of the seat 97 for the support arm of the suspended structure.

Figure 10:
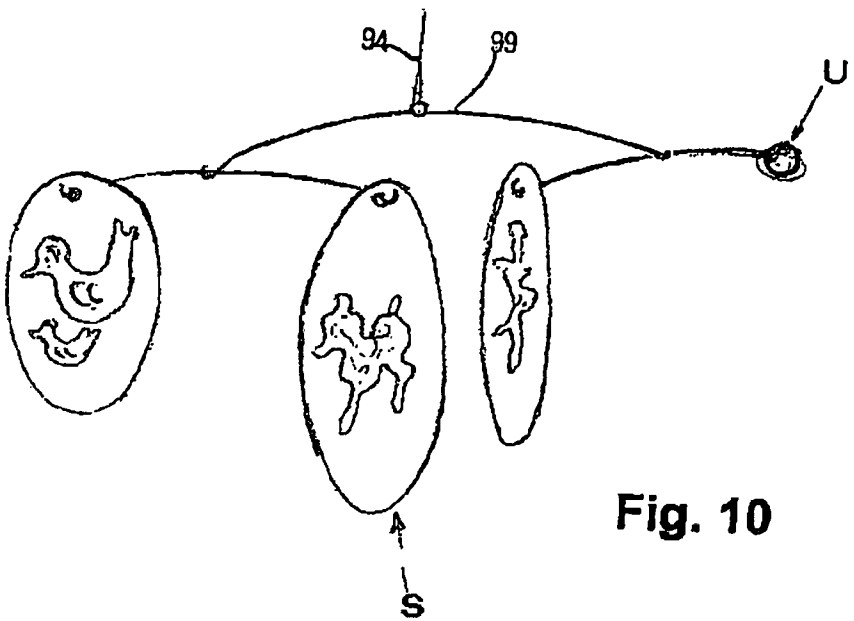

FIG. 10 is a perspective view of a possible example of a suspended structure with many arms; in this embodiment, there are not only the structures S but also a counterpoise U. This embodiment can be suspended from a ceiling, i.e. by a string 94.

Said first and second elements 1, 4 of the present structure need not to be equal to each other, as their shape and dimensions can be different from each other. The construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

What is claimed is:

1. A structure with variable geometric pattern and appearance which comprises:

a first element having a first aperture whose outline defines a preset geometric or fancy figure;

a flap or patch of fabric or cloth applied on the rear surface of said first element;

a second element associated with the rear surface of said first element on the back of said fabric so that the said fabric will be interposed between the first and second elements, the same fabric being able to partly project from the surface defined by said first element or said second element, the surface of the second element being provided with one or more apertures; the said one or more apertures defining one or more writings and/or figures visible inside the area delimited by said first aperture and visible against the light through the cloth.

2. The structure of claim 1, wherein said fabric is left loose, that is, not stretched.

3. The structure of claim 1, wherein said fabric is elastic.

4. The structure of claim 1, wherein said second element of the structure is, in turn, united to a third element.

5. The structure of claim 4, wherein said second and said third elements consist of one body joined by a fold.

6. The structure of claim 4, wherein said second and said third elements are made separate from each other and associated with each other upon making the structure.

7. The structure of claim 4, wherein said third element has a mirror-like reflecting surface.

8. The structure of claim 4, wherein said third element has a white or light beige surface which reflects the light at different angles in respect to the apertures of said second element, apertures which are delimited by a dark surface.

9. The structure of claim 4, wherein said third element has a dark surface which reflects the light at different angles in respect to the apertures of said second element, apertures which are delimited by a light surface.

10. The structure of claim 1, wherein said first element is provided with two apertures symmetrically disposed with respect to a hinge axis, and said second element is provided with two corresponding apertures shaped likewise the apertures of the first element, said apertures being so disposed as to coincide with each other when the structure is in closed condition, that is, folded over about said axis.

* * * * *